US009837195B2

(12) United States Patent
Yosui

(10) Patent No.: US 9,837,195 B2
(45) Date of Patent: Dec. 5, 2017

(54) MOUNTING STRUCTURE OF FLEXIBLE INDUCTOR AND ELECTRONIC DEVICE

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/930,688

(22) Filed: Nov. 3, 2015

(65) Prior Publication Data

US 2016/0055948 A1 Feb. 25, 2016

Related U.S. Application Data

(63) Continuation of application No. PCT/JP2014/064910, filed on Jun. 5, 2014.

(30) Foreign Application Priority Data

Jun. 14, 2013 (JP) ..... 2013-125937

(51) Int. Cl.
*H01F 27/29* (2006.01)
*H01F 5/00* (2006.01)
(Continued)

(52) U.S. Cl.
CPC ..... *H01F 5/003* (2013.01); *H01F 17/0006* (2013.01); *H01F 27/292* (2013.01); *H01F 2017/006* (2013.01)

(58) Field of Classification Search
CPC .. H01F 17/0006; H01F 5/003; H01F 27/2804; H01F 2017/006
USPC ..... 336/200, 223, 232, 192; 320/108
See application file for complete search history.

(56) References Cited

U.S. PATENT DOCUMENTS 7,710,341 B2 * 5/2010 Kubo ..... H01Q 7/08 340/572.7
2007/0229368 A1 * 10/2007 Hata ..... H01P 5/10 343/700 MS (Continued)

FOREIGN PATENT DOCUMENTS

JP 4-336486 A 11/1992
JP 2011-18505 A 1/2011

(Continued)

OTHER PUBLICATIONS

Official Communication issued in corresponding Japanese Patent Application No. 2015-522738, dated May 24, 2016.

(Continued)

*Primary Examiner* — Mangtin Lian
(74) *Attorney, Agent, or Firm* — Keating & Bennett, LLP

(57) ABSTRACT

A flexible inductor includes a first input/output terminal, a second input/output terminal, and a sheet-shaped and coil-shaped conductive pattern that includes a first end, which is connected to the first input/output terminal, and a second end, which is connected to the second input/output terminal, the first input/output terminal, the second input/output terminal, and the coil-shaped conductive pattern being provided on a flexible base member. The flexible inductor is positioned in the vicinity of a metallic part, which is disposed in a housing, or a metallic portion of the housing. The flexible inductor is bent and mounted in the housing in such a manner that one side of the coil-shaped conductive pattern that is close to the metallic part or the metallic portion is the inner side of the bent flexible inductor.

18 Claims, 9 Drawing Sheets

(51) Int. Cl.
*H01F 27/28* (2006.01)
*H01F 17/00* (2006.01)

(56) References Cited

U.S. PATENT DOCUMENTS

| | | | | |
|---|---|---|---|---|
| 2008/0278275 | A1* | 11/2008 | Fouquet | H01F 27/2804 336/84 M |
| 2013/0147581 | A1 | 6/2013 | Kato et al. | |
| 2013/0154891 | A1* | 6/2013 | Kubo | G06K 19/07779 343/788 |
| 2013/0293337 | A1* | 11/2013 | Lo | H01F 5/003 336/200 |
| 2014/0218262 | A1* | 8/2014 | Tsubaki | H01Q 7/00 343/867 |

FOREIGN PATENT DOCUMENTS

| | | | |
|---|---|---|---|
| JP | 2011-181621 | A | 9/2011 |
| JP | 2012-89700 | A | 5/2012 |
| JP | 2013-125818 | A | 6/2013 |
| WO | WO 2012/020581 | A1 * | 2/2012 |
| WO | 2012/074101 | A1 | 6/2012 |
| WO | 2013/051684 | A1 | 4/2013 |

OTHER PUBLICATIONS

Official Communication issued in International Patent Application No. PCT/JP2014/064910, dated Sep. 16, 2014.

* cited by examiner

MOUNTING STRUCTURE OF FLEXIBLE INDUCTOR AND ELECTRONIC DEVICE

BACKGROUND OF THE INVENTION

1. Field of the Invention

The present invention relates to a mounting structure of a flexible inductor that connects two circuits and an electronic device that includes the mounting structure.

2. Description of the Related Art

In the related art, an electronic device that uses a high-frequency signal often employs a structure in which the electronic device includes members of a mounting circuit, such as a plurality of substrates, in a housing of the electronic device, and in which the members are connected by flexible cables. In addition, there is a case where a planar coil-shaped conductive pattern is provided as a portion of a flexible cable as disclosed in, for example, Japanese Unexamined Patent Application Publication No. 2011-18505.

For example, in a small-sized communication terminal device, metallic objects, such as a ground conductor, a battery pack, and a shield case, are densely mounted. When a cable that includes a coil-shaped conductive pattern is mounted in such a small-sized electronic device, metallic parts (metallic objects) are forced to be positioned in the vicinity of the coil-shaped conductive pattern. As a result, an eddy current is generated in the metallic parts, and accordingly, the Q value of an inductor is decreased.

The influence of the metallic parts, which are positioned in the vicinity of the coil-shaped conductive pattern, can be reduced to a minimum value by forming a closed magnetic circuit structure by covering the coil-shaped conductive pattern with a magnetic material, such as ferrite, like the flexible cable described in Japanese Unexamined Patent Application Publication No. 2011-18505.

However, in the case of such a structure that includes a magnetic material, management and manufacturing processes for adding the magnetic material become complex, and in addition, the size of a flexible cable, which would have been thin, becomes large. In addition, in the case where a ceramic-based ferrite is used as the magnetic material, the flexibility of the flexible cable is degraded.

SUMMARY OF THE INVENTION

Accordingly, preferred embodiments of the present invention provide a mounting structure of a flexible inductor in which the flexible inductor is less likely to be influenced by a metallic part even if the flexible inductor is positioned in the vicinity of the metallic part, and also provide an electronic device that includes such a mounting structure.

A mounting structure includes a housing and a flexible inductor including a sheet-shaped flexible base member including an inductor, the sheet-shaped flexible base member including a first input/output terminal, a second input/output terminal, and a sheet-shaped and coil-shaped conductive pattern that includes a first end connected to the first input/output terminal, and a second end connected to the second input/output terminal, and that is wound several times. The flexible inductor is positioned near a metallic part disposed in the housing, or a metallic portion of the housing. The flexible inductor is bent and mounted in the housing in such a manner that one side of the coil-shaped conductive pattern that is close to the metallic part or the metallic portion is on an inner side of a bent portion of the flexible inductor.

The flexible base member may preferably include a first main surface and a second main surface, and the first main surface may preferably be spaced further apart from the metallic part or the metallic portion than the second main surface, and the first main surface may preferably include the coil-shaped conductive pattern.

An electronic device includes a flexible inductor including a sheet-shaped flexible base member including a first input/output terminal, a second input/output terminal, and a sheet-shaped and coil-shaped conductive pattern that is wound a plurality of times, and a housing configured to accommodate the flexible inductor. The flexible inductor is positioned near a metallic part disposed in the housing, or a metallic portion of the housing. The flexible inductor is bent and mounted in the housing in such a manner that one side of the coil-shaped conductive pattern that is close to the metallic part or the metallic portion is on an inner side of a bent portion of the flexible inductor.

The metallic part or the metallic portion may preferably be a ground electrode of a wiring board disposed in the housing.

According to various preferred embodiments of the present invention, a magnetic field on the inner side of a flexible inductor, which is bent, is weak relative to a magnetic field on the outer side of the bent flexible inductor, and even if a metallic part is present on the inner side of the bent flexible inductor, the flexible inductor is less likely to be influenced by the metallic part. Therefore, a significant decrease in the Q value of the flexible inductor due to the metallic part, which is positioned in the vicinity of the flexible inductor, is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
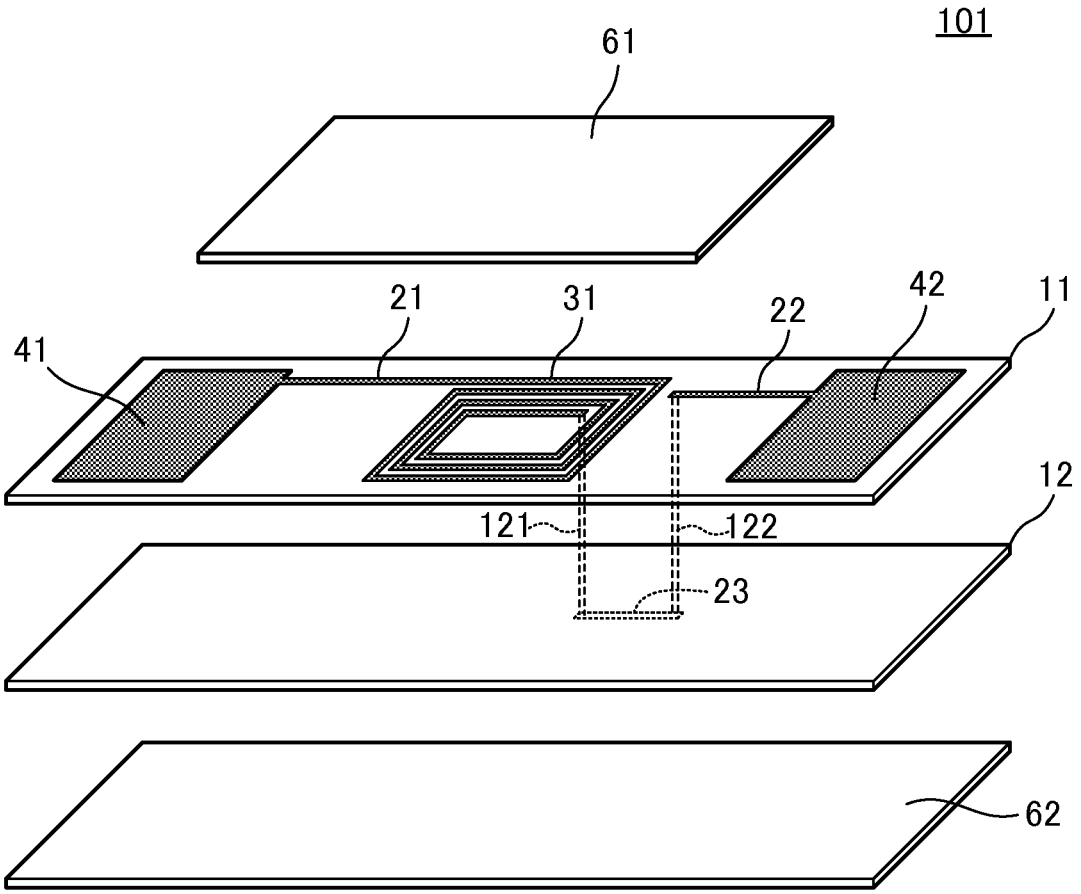
FIG. 1 is an exploded perspective view of a flexible inductor according to a first preferred embodiment of the present invention.
Figure 2A:
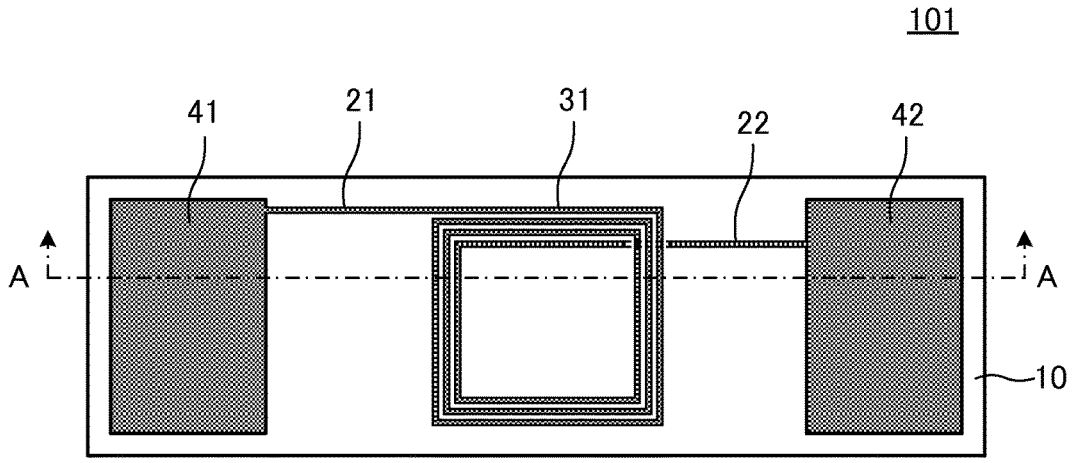
FIG. 2A is a plan view of the flexible inductor.
Figure 2B:
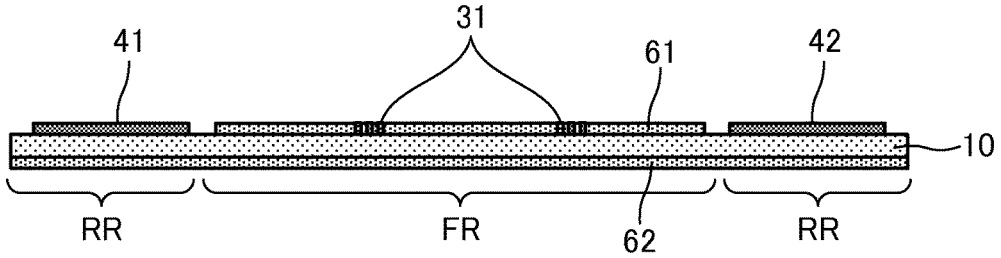
FIG. 2B is a sectional view taken along line A-A of FIG. 2A.

FIG. 1 is an exploded perspective view of a flexible inductor 101 according to a first preferred embodiment of the present invention. FIG. 2A is a plan view of the flexible inductor 101, and FIG. 2B is a sectional view taken along line A-A of FIG. 2A.

The flexible inductor 101 includes a flexible base member 10 that preferably is a multilayer body, which includes flexible resin base members 11 and 12, and various conductive patterns that are provided on the resin base members 11 and 12.

The resin base member 11 preferably has a rectangular (elongated) planar shape, and a first input/output terminal 41 and a second input/output terminal 42 are respectively provided on a first end portion and a second end portion of a top surface of the resin base member 11. In addition, wiring patterns 21 and 22 are provided on the top surface, and a conductive pattern having a rectangular spiral shape is provided on a substantially central portion of the top surface. A wiring pattern 23 is provided on a bottom surface of the resin base member 12.

The wiring pattern 21 connects an outer periphery end of the conductive pattern 31 and the first input/output terminal 41. A first end of the wiring pattern 22 is connected to the second input/output terminal 42. The wiring pattern 23 connects an inner periphery end of the conductive pattern 31 and a second end of the wiring pattern 22 via interlayer connection conductors (via hole conductors) 121 and 122, which are provided in the resin base members 11 and 12.

Each of the resin base members 11 and 12 preferably is formed by, for example, molding a resin, such as a liquid crystal polymer (LCP) or a thermoplastic polyimide, into the form of a sheet and corresponds to the "flexible base member". The conductive pattern 31 preferably having a rectangular spiral shape is formed by, for example, patterning a metal thin film, such as a Cu foil or an Al foil, into a spiral shape and corresponds to the "coil-shaped conductive pattern". The conductive pattern 31 preferably having a rectangular spiral shape also has flexibility.

A resist layer 61 is formed in a region of the top surface of the resin base member 11 excluding regions in which the first input/output terminal 41 and the second input/output terminal 42 are located. A resist layer 62 is formed over the entire bottom surface of the resin base member 12. Note that the resist layer 62 need not be provided. In addition, the resist layer 62 is also flexible, and accordingly, the entire flexible inductor 101 has flexibility.

The flexible base member 10, which is illustrated in FIGS. 2A and 2B, is formed preferably by stacking the resin base members 11 and 12, which are illustrated in FIG. 1, one on top of the other. The conductive pattern 31 having a spiral shape is a so-called several-turn planar coil pattern that is wound several times, and a coil axis of the conductive pattern 31 is oriented in a perpendicular or substantially perpendicular direction with respect to a surface of the flexible base member 10.

The conductive pattern 31, the first and second input/output terminals 41 and 42, the wiring patterns 21 to 23 each include a metal foil such as, a Cu foil or an Al foil, and are each harder than the resin base members 11 and 12, and thus, in FIG. 2B, the region in which the first input/output terminal is located is a relatively rigid region RR due to the presence of the first input/output terminal 41, which has a large area. Similarly, the region in which the second input/output terminal 42 is located is another relatively rigid region RR due to the presence of the second input/output terminal 42, which has a large area. The region other than the rigid regions RR is a flexible region FR.

Figure 3:
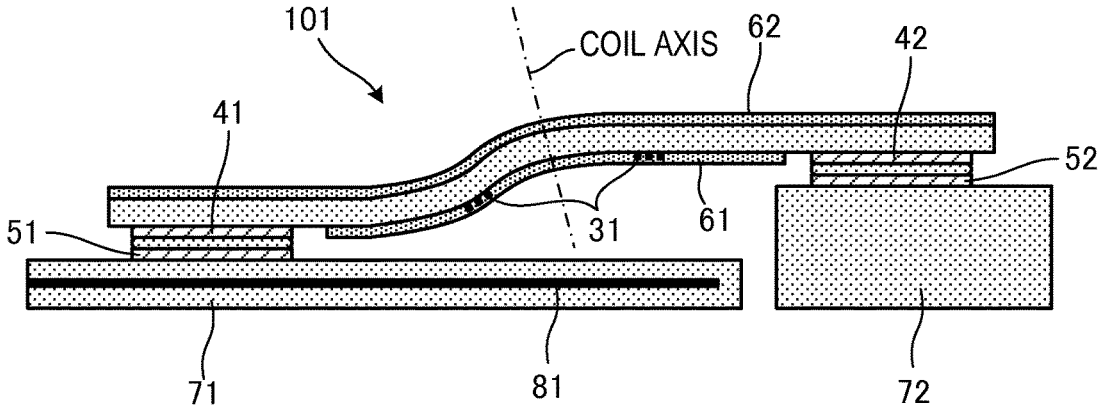
FIG. 3 is a sectional view of the flexible inductor at a mounting position.
Figure 4:
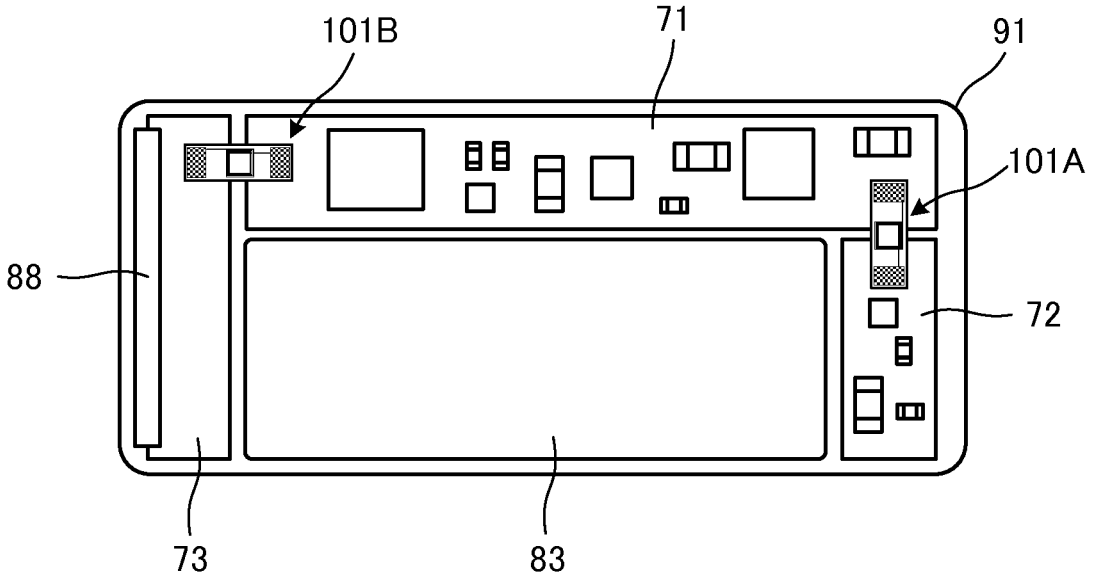
FIG. 4 is a plan view of an electronic device that includes flexible inductors disposed in a housing of the electronic device.

FIG. 3 is a sectional view of the flexible inductor 101 at a mounting position. FIG. 4 is a plan view of an electronic device that includes flexible inductors 101A and 101B disposed in a housing of the electronic device.

As illustrated in FIG. 3, printed wiring boards 71 and are different circuit boards like, for example, an antenna substrate and an RF circuit board. Connection electrodes 51 and 52 are respectively provided on the printed wiring boards 71 and 72, and the first and second input/output terminals 41 and 42 of the flexible inductor 101 are respectively soldered to the connection electrodes 51 and 52. Note that the method of connecting the flexible inductor 101 to a substrate may be connector connection using a surface mount connector.

A ground electrode 81 is provided in the printed wiring board 71. The connection electrode 51 on the printed wiring board 71 and the connection electrode 52 on the printed wiring board 72 are positioned at different levels, and the flexible inductor 101 is mounted in a state where the conductive pattern 31, which is a coil-shaped conductive pattern, is bent. In other words, the coil axis of the conductive pattern 31 is bent in such a manner that one side of the coil axis closer to the ground electrode 81 of the printed wiring board 71 than the other side is the inner side of the flexible inductor 101, which is bent.

In the example illustrated in FIG. 4, the printed wiring boards 71 and 72, a printed wiring board 73, a battery pack 83, and the like are accommodated in a housing 91 of a communication terminal device, such as a smartphone or a tablet terminal, or the like. The printed wiring board 73 is provided with an antenna 88. The printed wiring boards 71 and 72 are connected to each other by a flexible inductor 101A, and the printed wiring boards 71 and 73 are connected to each other by a flexible inductor 101B. The structure of each of the flexible inductors 101A and 101B is the same as that of the flexible inductor 101 illustrated in FIG. 1 and FIGS. 2A and 2B.

Figure 5A:
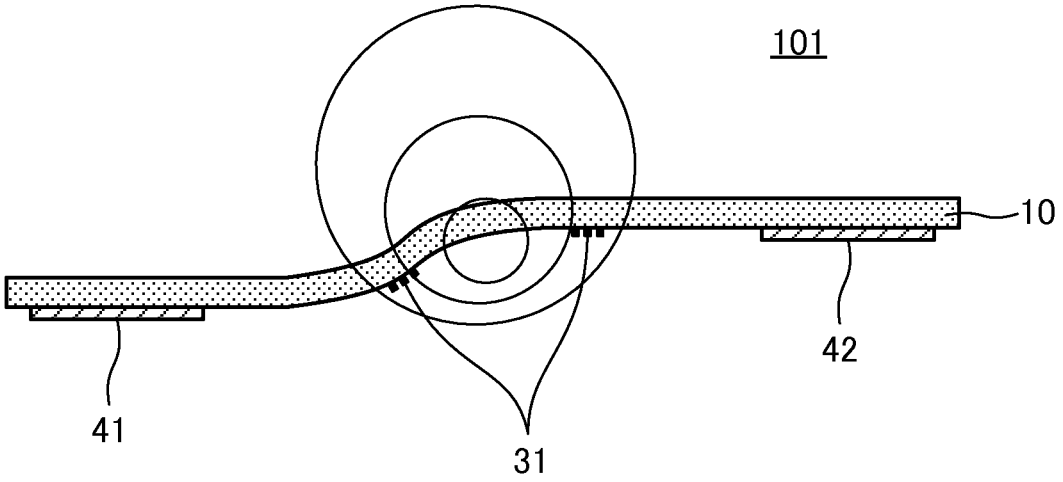
FIGS. 5A and 5B are conceptual diagrams illustrating the intensity of a magnetic field generated by a conductive pattern of the flexible inductor, the conductive pattern having a rectangular spiral shape.
Figure 5B:
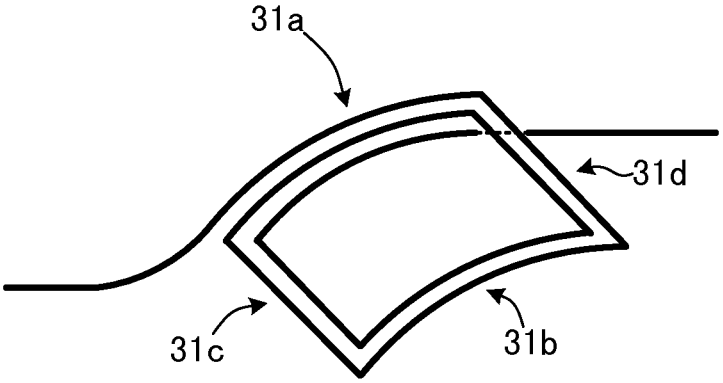

FIGS. 5A and 5B are conceptual diagrams illustrating the intensity of a magnetic field generated by the conductive pattern 31 of the flexible inductor 101, the conductive pattern 31 preferably having a rectangular spiral shape. FIG. 5A is a sectional view of the flexible inductor 101 with magnetic equipotential lines representing the intensity of the magnetic field generated by the conductive pattern 31, and FIG. 5B is a diagram illustrating four sides 31*a*, 31*b*, 31*c*, and 31*d* of the conductive pattern 31.

The sides 31*a* and 31*b* of the conductive pattern 31 are curved as a result of the flexible inductor 101 being bent. Consequently, a magnetic field generated by a current that flows through the sides 31*a* and 31*b* of the conductive pattern 31 will be expanded to the inner side of the bent flexible inductor 101 to only a small extent and will be expanded to the outer side of the bent flexible inductor 101 to a relatively large extent. This will become notable as the number of times the conductive pattern 31 is wound (the number of turns of the conductive pattern 31) increases, and thus, it is preferable that the number of times the conductive pattern 31 is wound be two or more, or more preferably, three or more. Therefore, the magnetic field generated by the conductive pattern 31 will not be strongly coupled with a metallic part, such as a ground electrode, and an eddy current that will be generated in the metallic part is small. Accordingly, a decrease in the Q value of the flexible inductor 101 is significantly reduced or prevented.

Second Preferred Embodiment

Figure 6A:
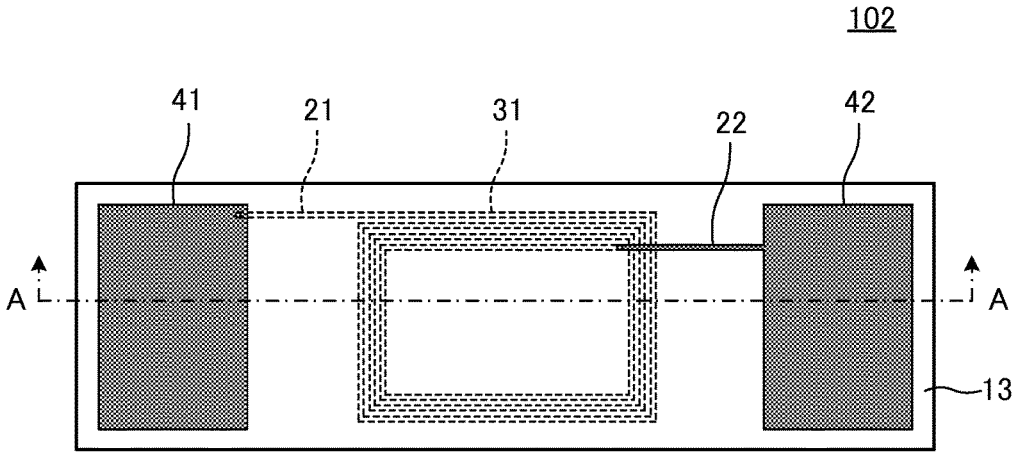
FIG. 6A is a plan view of a flexible inductor according to a second preferred embodiment of the present invention.
Figure 6B:
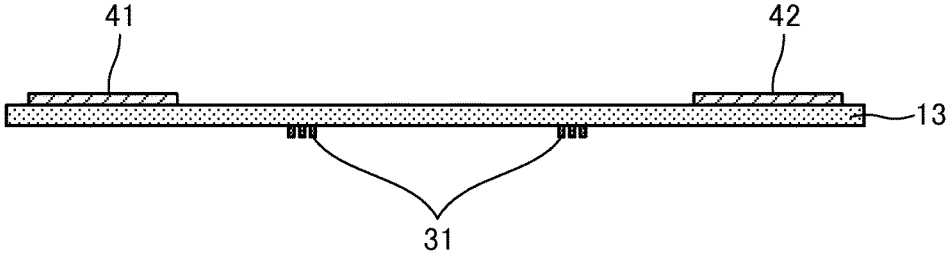
FIG. 6B is a sectional view taken along line A-A of FIG. 6A.

FIG. 6A is a plan view of a flexible inductor 102 according to a second preferred embodiment of the present invention, and FIG. 6B is a sectional view taken along line A-A of FIG. 6A.

The flexible inductor 102 includes various conductive patterns provided on a flexible base member 13, which is a flexible resin base member.

A first input/output terminal 41, a second input/output terminal 42, and a wiring pattern 22 are provided on a top surface of the flexible base member 13. A wiring pattern 21, and a conductive pattern 31, which preferably has a rectangular spiral shape, are provided on a bottom surface of the flexible base member 13. In addition, an interlayer connection conductor, such as a plated through hole or a via hole conductor, that connects the wiring pattern 21 and the first input/output terminal 41 and an interlayer connection conductor, such as a plated through hole or a via hole conductor, that connects the wiring pattern 22 and the conductive pattern 31 are provided in the flexible base member 13.

As described above, a single-layer flexible resin base member that does not have a multilayer structure may be used as the flexible base member 13.

Figure 7:
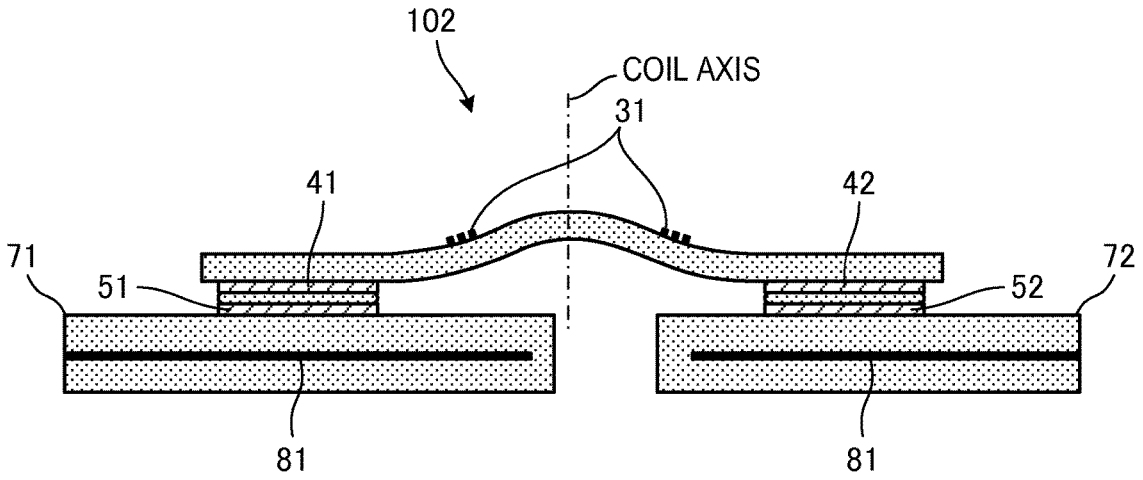
FIG. 7 is a sectional view of the flexible inductor at a mounting position.
Figure 8:
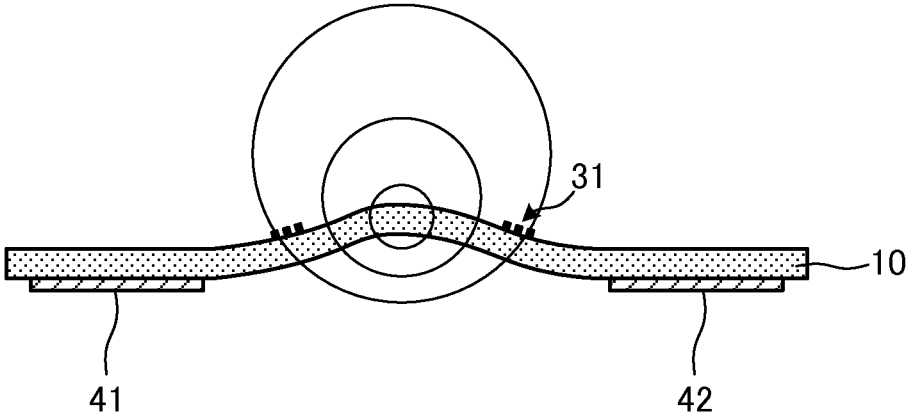
FIG. 8 is a conceptual diagram illustrating the intensity of a magnetic field generated by a conductive pattern of the flexible inductor.

FIG. 7 is a sectional view of the flexible inductor 102 at a mounting position. FIG. 8 is a conceptual diagram illustrating the intensity of a magnetic field generated by the conductive pattern 31 of the flexible inductor 102.

A ground electrode 81 is provided in the printed wiring boards 71 and 72. Connection electrodes 51 and 52 are respectively provided on the printed wiring boards 71 and 72, and the first and second input/output terminals 41 and 42 of the flexible inductor 102 are respectively soldered to the connection electrodes 51 and 52.

Similar to the flexible inductor 101 of the first preferred embodiment, as a result of the flexible inductor 102 being bent, a magnetic field generated by the conductive pattern 31 will not be strongly coupled with a metallic part, such as a ground electrode. Therefore, an eddy current that will be generated in the metallic part is small, and a decrease in the Q value of the flexible inductor 102 is significantly reduced or prevented.

In particular, since the conductive pattern 31 is provided on one of main surfaces of the flexible base member 13 that is positioned farther from the metallic part, the conductive pattern 31 is at a position that is spaced apart from the metallic part, and a decrease in the Q value of the flexible inductor 102 is more effectively significantly reduced or prevented.

Third Preferred Embodiment

Figure 9:
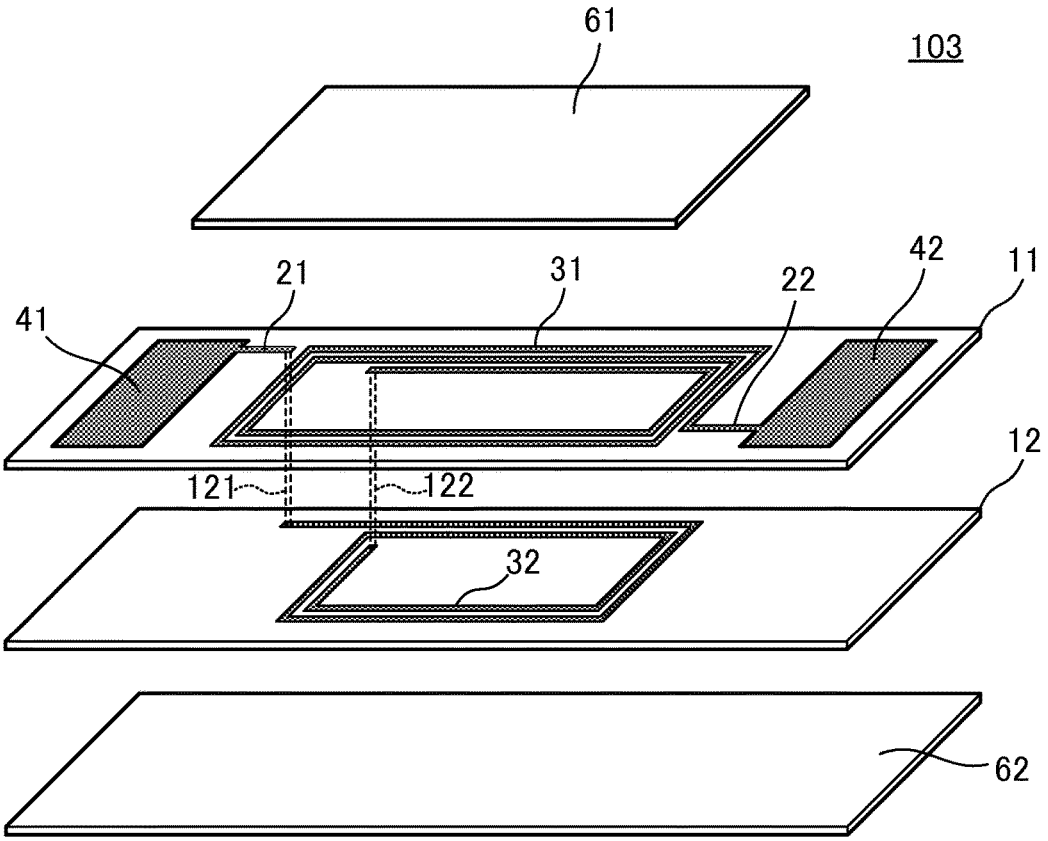
FIG. 9 is an exploded perspective view of a flexible inductor according to a third preferred embodiment of the present invention.

FIG. 9 is an exploded perspective view of a flexible inductor 103 according to a third preferred embodiment of the present invention. Unlike the flexible inductor 101 of the first preferred embodiment illustrated in FIG. 1, conductive patterns 31 and 32 each preferably having a rectangular spiral shape are respectively formed on resin base members 11 and 12. An inner periphery end of the conductive pattern 31 and an inner periphery end of the conductive pattern 32 are connected to each other by a via hole conductor 122. An outer periphery end of the conductive pattern 32 and an end of wiring pattern 21 are connected to each other by a via hole conductor 121. In other words, the conductive patterns 31 and 32, each of which has a coil shape, define a multilayer coil pattern. The rest of the configuration of the flexible inductor 103 is the same as that of the flexible inductor 101 described in the first preferred embodiment.

In the flexible inductor 103 of the third preferred embodiment, the opening diameter of a coil, which is the conductive pattern 31, is larger than the opening diameter of a coil, which is the conductive pattern 32. The conductive pattern 31, which is the coil having a large opening diameter, is located closer to a metallic part than the conductive pattern 32, and is to be located on the inner side of the flexible inductor 103 when the flexible inductor 103 is bent. With this configuration, an advantageous effect in which a magnetic field generated by the coil expands in a direction toward the outer side of the bent flexible inductor 103 to a larger extent than in a direction toward the inner side of the bent flexible inductor 103 is obtained.

Note that, although the case where the flexible inductor 101 is preferably positioned in the vicinity of a metallic part, which is disposed in a housing, has been described in some of the above preferred embodiments, the present invention can also be applied to the case where the metallic part is a portion of a metallic housing. In addition, the conductive pattern 31, which is the coil-shaped conductive pattern, may be a single-function inductance element as in the preferred embodiments, and alternatively, for example, the flexible inductor 101 may further include a capacitance element and define a resonance circuit together with the coil-shaped conductive pattern. Alternatively, the flexible inductor 101 may be used as a coil antenna of an HF communication system.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A mounting structure comprising:

a housing; and a flexible inductor including a sheet-shaped flexible base member including an inductor, the sheet-shaped flexible base member including:

a first end portion;

a second end portion located on a side opposite to the first end portion;

a first input/output terminal in contact with the first end portion;

a second input/output terminal in contact with the second end portion; and a sheet-shaped and coil-shaped conductive pattern that includes a first end connected to the first input/output terminal, and a second end connected to the second input/output terminal, and that is wound a plurality of times; wherein the flexible inductor is positioned near a metallic part disposed in the housing, or a metallic portion of the housing;

the flexible inductor is bent and mounted in the housing in such a manner that one side of the coil-shaped conductive pattern that is close to the metallic part or the metallic portion is on an inner side of a bent portion of the flexible inductor;

the first input/output terminal of the flexible inductor is connected to a first substrate; and the second input/output terminal of the flexible inductor is connected to a second substrate different from the first substrate.

2. The mounting structure according to claim 1, wherein the flexible base member includes a first main surface and a second main surface;

the first main surface is spaced farther apart from the metallic part or the metallic portion than the second main surface; and the first main surface includes the coil-shaped conductive pattern.

3. The mounting structure according to claim 1, wherein the metallic part or the metallic portion is a ground electrode of a wiring board disposed in the housing.

4. The mounting structure according to claim 1, wherein the flexible base member is made of resin.

5. The mounting structure according to claim 1, wherein the flexible base member has a rectangular or substantially rectangular shape.

6. The mounting structure according to claim 1, wherein the flexible base member includes interlayer connection conductors that connect the first input/output terminal, the second input/output terminal, and the conductive pattern.

7. The mounting structure according to claim 1, further comprising a resist layer on a top surface of the flexible base member.

8. The mounting structure according to claim 1, wherein the flexible base member includes a plurality of resin base members stacked on each other.

9. An electronic device comprising:

a flexible inductor including a sheet-shaped flexible base member including:

a first end portion;

a second end portion located on a side opposite to the first end portion;

a first input/output terminal in contact with the first end portion;

a second input/output terminal in contact with the second end portion; and a sheet-shaped and coil-shaped conductive pattern that is wound a plurality of times; and a housing configured to accommodate the flexible inductor; wherein the flexible inductor is positioned near a metallic part disposed in the housing, or a metallic portion of the housing;

the flexible inductor is bent and mounted in the housing such that one side of the coil-shaped conductive pattern that is close to the metallic part or the metallic portion is on an inner side of a bent portion of the flexible inductor;

the first input/output terminal of the flexible inductor is connected to a first substrate; and the second input/output terminal of the flexible inductor is connected to a second substrate different from the first substrate.

10. The electronic device according to claim 9, wherein the metallic part or the metallic portion is a ground electrode of a wiring board disposed in the housing.

11. The electronic device according to claim 9, further comprising a first wiring board and a second wiring board, wherein the flexible inductor is connected to and between the first wiring board and the second wiring board.

12. The electronic device according to claim 11, wherein the first wiring board is an antenna substrate and the second wiring board is an RF circuit board.

13. The electronic device according to claim 9, wherein the electronic device is one of a phone and a tablet terminal.

14. The electronic device according to claim 9, wherein the flexible base member is made of resin.

15. The electronic device according to claim 9, wherein the flexible base member has a rectangular or substantially rectangular shape.

16. The electronic device according to claim 9, wherein the flexible base member includes interlayer connection conductors that connect the first input/output terminal, the second input/output terminal, and the conductive pattern.

17. The electronic device according to claim 9, further comprising a resist layer on a top surface of the flexible base member.

18. The electronic device according to claim 9, wherein the flexible base member includes a plurality of resin base members stacked on each other.

* * * * *